US005081472A

United States Patent [19]

Fisher

[11] Patent Number: 5,081,472

[45] Date of Patent: Jan. 14, 1992

[54] CLEANING DEVICE FOR INK JET PRINTHEAD NOZZLE FACES

[75] Inventor: Almon P. Fisher, Rochester, N.Y.

[73] Assignee: Xerox Corporation, Stamford, Conn.

[21] Appl. No.: 636,827

[22] Filed: Jan. 2, 1991

[51] Int. Cl.[5] ..... B41J 2/165

[52] U.S. Cl. ..... 346/140 R; 400/126

[58] Field of Search ..... 346/140 R; 400/701, 400/702, 702.1, 126

[56] References Cited

U.S. PATENT DOCUMENTS

| | | | |
|---|---|---|---|
| 4,306,245 | 12/1981 | Kasugayama et al. | 346/140 R |
| 4,371,881 | 2/1983 | Bork et al. | 346/140 R |
| 4,853,717 | 8/1989 | Harmon et al. | 346/140 R |
| 4,935,753 | 6/1990 | Lehmann et al. | 346/140 R |

FOREIGN PATENT DOCUMENTS

| | | | |
|---|---|---|---|
| 0115863 | 7/1984 | Japan | 346/140 R |
| 0251146 | 10/1987 | Japan | 346/140 R |

OTHER PUBLICATIONS

"Nozzle Guard and Maintenance Station for Drop-on-Demand Printheads" IBM Technical Disclosure Bulletin; vol. 27, No. 12 May 1985.

"Impeller-Assisted Cleaning Blade" IBM Technical Disclosure Bulletin vol. 31, No. 6, Nov. 1988.

*Primary Examiner*—Benjamin R. Fuller
*Assistant Examiner*—Alrick Bobb
*Attorney, Agent, or Firm*—Robert A. Chittum

[57] ABSTRACT

A cleaning device for removal of ink and other debris from the nozzle face of an ink jet printhead is disclosed. The cleaning device is located at a cleaning and priming station within the printer, and comprises a rotatable drum having at least one slot in which an absorbent material covered with a polymeric mesh material is manually inserted. When the printhead is located in the cleaning and priming station, the drum is rotated and the covered absorbent material wipes the nozzle face. In one embodiment, the printer is a carriage type with the cleaning station on one side of the printing region. The drum is surrounded by a housing with an opening so that the covered absorbent material is rotated therepast and into contact with the nozzle face of the printhead. The absorbent material is moistened to assist in cleaning the nozzle face in preventing ink removed from the nozzle face from drying on the mesh material. In a second embodiment, the drum has two slots, one for a dry cleaning member and one for a moistened cleaning member. Similar cleaning devices are disclosed for pagewidth printheads.

22 Claims, 4 Drawing Sheets

CLEANING DEVICE FOR INK JET PRINTHEAD NOZZLE FACES

BACKGROUND OF THE INVENTION

This invention relates to thermal ink jet printing and, more particularly, to a cleaning and priming station where the printhead nozzle faces are cleaned by a rotary cleaning device.

The ink jet printing system may be incorporated in either a carriage type printer or a pagewidth type printer. The carriage type printer generally has a relatively small printhead containing the ink channels and nozzles. The printhead is usually sealingly attached to a disposable ink supply cartridge and the combined printhead and cartridge assembly is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. In contrast, the pagewidth printer has a stationary printhead having a length equal to or greater than the width of the paper. The paper is continually moved past the pagewidth printhead in a direction normal to the printhead length and at a constant speed during the printing process.

Thermal ink jet printing devices, because of the close tolerances between the recording medium and the printhead nozzles and the small size of the nozzles themselves, require periodic cleaning of the printhead nozzle faces due to the buildup of recording medium fibers, dust, and ink which builds up theron. Most of the ink and debris are removed from the vicinity of the nozzles during the priming operation in which ink is either drawn under a vacuum from the nozzles at the priming station, or ink is forced from the nozzles under pressure at the priming station. However, any partially or fully dried ink and any contamination debris within the vicinity of the nozzles will produce a directionality problem with the ejected droplets. Therefore, the nozzle face of the printhead must be cleaned to enable commercially acceptable printed documents by the printers. Numerous configurations of nozzle face cleaning devices are known for removing collected ink and other contaminates from the nozzle faces of the printhead, such as, by use wipers and blades and the like, but all impose some constraints or compromise which impacts the printer cost, size, or printer operation.

U.S. Pat. No. 4,935,753 to Lehmann et al discloses an apparatus for cleaning the nozzle surface of an ink jet printhead. The apparatus comprises wiping lips which are wedge shaped and located on an endless belt which rotates on two rollers. A band cleaning device, preferably using spiral wiping edges, is located under the endless belt for cleaning ink from the endless belt and the wiping lips.

U.S. Pat. No. 4,371,881 to Bork et al discloses a pivotal ink shield for the writing head of an ink recording device. The shield is movable relative to the writing head opening to shield, wipe, and flush writing head outlets.

Copending U.S. patent application entitled "A Clean Printhead Cleaner", U.S. Ser. No. 07/528,765 to Markham, filed May 25, 1990, and commonly assigned to the assignee of the present invention discloses a rotary cleaning device for periodically cleaning ink jet printhead nozzles. A rotary cleaning device has at least one flexible wiping blade which is attached to a rotatable support. The rotatable support is attached to a shaft which is rotatably driven by a dedicated motor or connected through linkages to be driven off other motors already existing in a printer. A rotary support is preferably cylindrical and the flexible wiping blade preferably mounted thereon following a helical path along the surface thereof. A cleaning device also includes a means for cleaning the blade to remove any ink or other contaminates from the blade in order to prevent deterioration of the cleaning quality of the wiping blade. A wet type washing blade may also be added to provide a means for washing the printhead nozzle face with a solvent prior to wiping by the blade to aid in removal of any dried ink.

SUMMARY OF THE INVENTION

It is an object of the present invention to provide a cleaning device for the printhead nozzle faces by mildly scrubbing the nozzle face to remove any excess ink following a priming operation or a printing operation without introducing any contamination into the nozzles.

It is another object of the invention to provide a cleaning device using an absorbent material covered by a suitable film-forming polymer in the form of a filter mesh having predetermined pores or spaces which will wick ink very efficiently. The mesh filter material provides a clean gentle midly abrasive surface for cleaning the printhead without damage thereto. In addition, the mesh material acts as a barrier which prevents particles and fibers from the internal absorbent material from escaping therethrough and reaching the nozzle face.

It is still another object of the invention to provide a humid environment for the cleaning device so that the mesh material covering the absorbent material used to clean the printhead nozzle face does not become clogged with dried ink.

It is yet another object of the present invention to provide a rotary cleaning device which concurrently mildly scrubs and removes ink and other debris from all nozzle faces of a plurality of printheads, each containing a different color of ink, without the possibility of the cleaning device mixing ink as it cleans.

In the present invention, a rotary cleaning device is located within a cleaning and priming station for the ink jet printer and comprises a rotatable drum having at least one slot in which an absorbent material covered with a polymeric mesh material is utilized for the removal of ink and other debris from the ink jet printhead faces while the printheads are positioned at the cleaning and priming station. In one embodiment, the printer is a carriage type with the cleaning station on one side of the printing region. The drum is surrounded by a housing with an opening which confronts the printheads, so that the covered absorbent material is rotated in manner to contact and wipe the nozzle face of the printheads. The absorbent material is moistened to assist in cleaning the nozzle face and to prevent ink removed from the nozzle face from drying on the mesh material. Because the rotatable cleaning device is used as part of the priming station which requires a humid environment, keeping the absorbent material moist is not a problem. In a second embodiment, the drum has two slots, one for a dry cleaning member and one for a moistened cleaning member. Similar cleaning devices are disclosed for cleaning the nozzle faces of a pagewidth printer. In all embodiments the mesh covered absorbent material is readily removed from and replaced in the drum slots by an end user of the ink jet printer without the need to call a skilled technician.

A more complete understanding of the present invention can be obtained by considering the following detailed description in conjunction with the accompanying drawings wherein like index numerals indicated like parts.

DESCRIPTION OF THE PREFERRED EMBODIMENT

Figure 1:
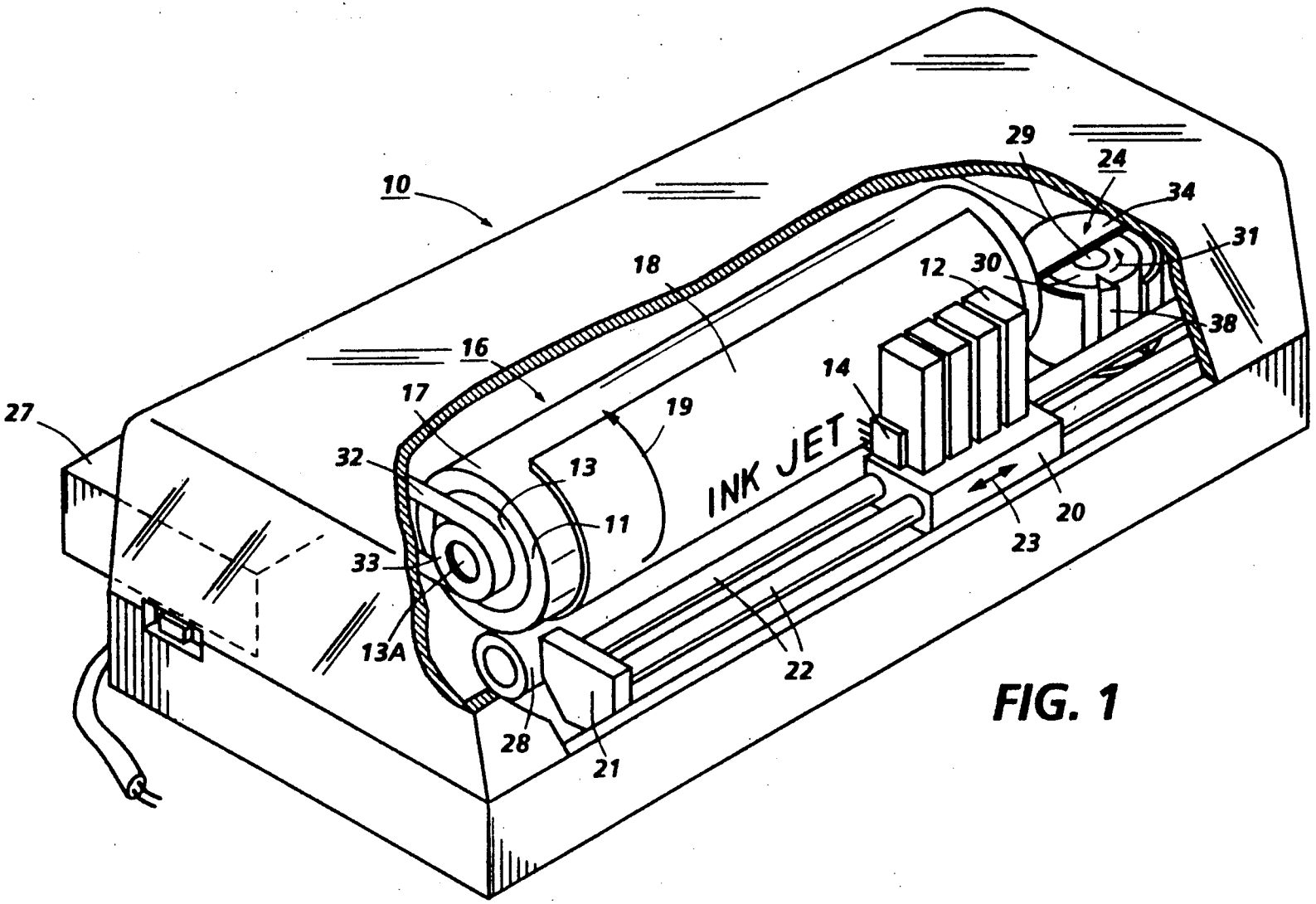
FIG. 1 is a schematic isometric view of a multicolor carriage type thermal ink jet printer showing a plurality of disposable ink cartridges having integral printheads mounted on a translatable carriage with the nozzle face cleaning device of the present invention shown located at one end of the printing region.

In FIG. 1, a multicolor thermal ink jet printer 10 is shown containing several disposable ink supply cartridges 12, each with an integrally attached printhead 14. The ink cartridge and printhead combination are removably mounted on a translatable carriage 20 disposed in a printing region adjacent a recording medium 18, such as paper, on surface 17 of cylindrical platen 16. During the printing mode, the carriage reciprocates back and forth on, for example, guide rails 22, parallel to the axis of platen 16 as depicted by arrow 23. The platen has a diameter of between 10 and 20 cm and is constructed, for example, out of an aluminum sleeve 11 with endcaps 13 containing a shaft 13A therethrough which has a pulley 33 mounted on one end and driven by timing belt 32 via a stepping motor (not shown). The platen shaft is rotatably mounted in frame sides 21 which also contain the ends of guide rails 22. The carriage is driven back and forth across the length of the intermediate drum by well known means such as, for example, by cable and pulley with a reversible motor (not shown).

Each cartridge 12 contains a different ink, one black and one to three cartridges of different selected colors. The combined cartridge and printhead is removed and discarded after the ink supply in the cartridge has been depleted. In this environment, some of the nozzles do not eject droplets during one complete carriage traversal and, generally, none of the nozzles eject droplets as the printheads move beyond the edge of the intermediate drum. While at this end of the carriage traversal, there is a small dwell time while the platen with the recording medium is being stepped one swath in height in the direction of arrow 19. A cleaning and priming station 24 is located on one side of the platen where the nozzle face 25 containing nozzles 26 of the printhead 14 (see FIG. 2) is cleaned, as described below, and the less used nozzles may fire nozzle-clearing droplets, and/or where the nozzles may be capped (by well known means, not shown) to prevent them drying out during extended idle times when the printer is not being used. A supply of cut sheet recording medium 18, such as paper, is provided in cassette 27 inserted in the back of the printer 10, from which the sheets are forwarded through the nip formed by the platen 16 and idler roll 28. The ink jet image is printed in the printing region, defined by the width of the recording medium or paper on the platen, one swath at a time. The platen with the paper is stepped the distance of the height of a printed swath of information and another swath is printed contiguous therto until the entire sheet of paper is printed, after which the printed sheet is discharged into a tray (not shown) above the cassette in the back of the printer.

The cleaning and priming station 24 is located beyond one end of the platen 16 and adjacent the guide rails 22, so that carriage 20 may periodically move the printheads 14 thereto, and, when the printer is not printing, the printheads are parked closely adjacent the station. The cleaning and priming station comprises a rotatable structure, such as a hollow cylindrical drum 30, vertically mounted on a rotatable shaft 29 and selectively rotated in the direction of arrow 31 by any well known means, such as by a separate electrical motor (not shown). The drum 30 is surrounded by a housing 34 having an opening 35 (see FIG. 2) and a bearing seal (not shown) for penetration of the drum shaft 29 for connection to the drive motor. The drum has at least one vertical slot (see FIGS. 2 and 4) extending the length of the drum into which a resilient, consumable cleaning member 38 is manually inserted. The geometric configurations of the cleaning member and the drum slot are determined so that, when the cleaning member is inserted into the slot, there is enough frictional engagement to retain the cleaning member in the slot until it is replaced with a fresh cleaning member. Alternatively, one side of the slot could be spring biased (not shown) for added gripping power.

The top of the housing 34 (partially shown in FIG. 1) is removably but sealingly attached by, for example, pivotable clips fixedly attached to the side of the housing (not shown). This enables the removal of the housing top for purposes of replacing soiled cleaning members 38. Each cleaning member 38 comprises an absorbent material such as, for example, lint-free cloth wrapped or encased in a suitable film-forming polymer fabricated as a mesh material having a pore size of 10–40 μm. The particular preferred film-forming polymer is Nylon® because it is very durable and wear resistant. Any absorbent material is sufficient so long as it does not break apart or generate contaminating particles or fibers which will escape through the pores of the covering mesh material.

Figure 2:
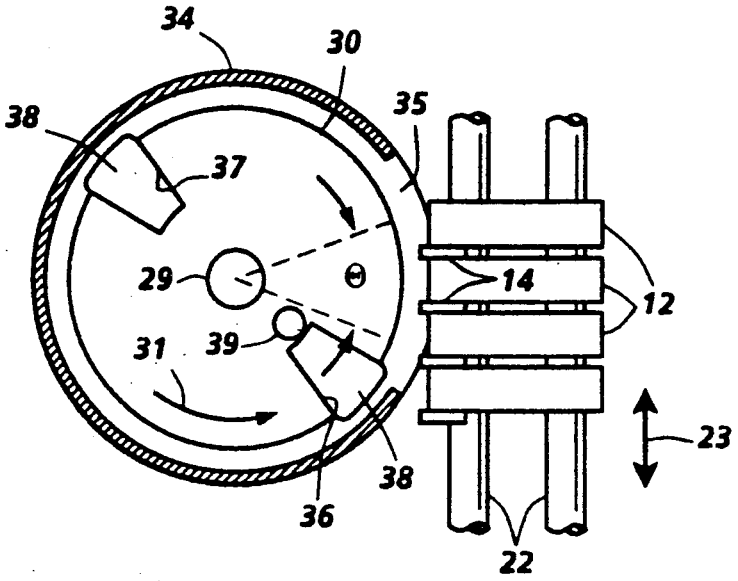
FIG. 2 is a top view of the cleaning device shown in FIG. 1.

Referring to FIG. 2, a partially shown top view of one embodiment of the present invention, the drum has two slots 36, 37, each containing a cleaning member 38. The cleaning member in slot 36 is maintained moist by a cleaning liquid which may be suitable solvent or water, since the ink used by the printer is water based. The cleaning liquid is applied to the cleaning member from a small tank (not shown) adjacent the bottom of the drum slot 36 which is connected to the cleaning member therein by a small passageway or wick (not shown). The tank of cleaning liquid is resupplied through the removable lid 39. The housing opening 35 confronts the printheads 14 when they are moved to the cleaning and priming station. Upon activation of drive motor for the drum 30, the drum rotates in the direction of arrow 31 and as it sweeps through arcuate cleaning region $\theta$ of between 15 to 30 degrees circumferential movement about the axis of rotation of shaft 29.

The drum of FIG. 2 is always rotated so that the moist cleaning member wipes and mildly scrubs the nozzle face of the printheads first, followed by the wiping and mildly scrubbing of the nozzle faces by the dry cleaning member. In the multicolor printer, where several printheads are required, the carriage is stopped adjacent the arcuate cleaning region with the nozzle face of the first printhead to be cleaned first, and then each of the other printheads are stepped into the cleaning location one at a time until all of the nozzle faces are cleaned.

Figure 3:
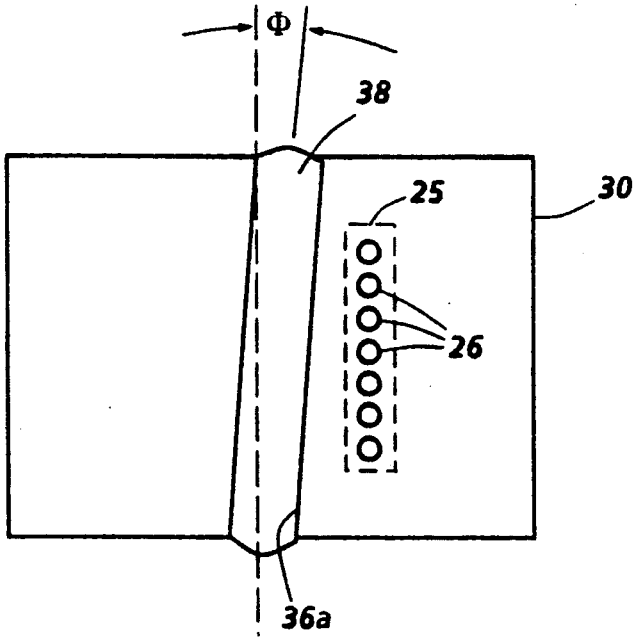
FIG. 3 is a side view of an alternate embodiment of the cleaning device shown in FIG. 2.

FIG. 3 shows the preferred embodiment of a side view of the drum 30 and cleaning member 38 with the confronting nozzle face 25 and nozzles 26 therein shown in dashed line. The slot 36*a* for moist cleaning member 38 and slot 37*a* (not shown) are slightly skewed by the angle $\Phi$ of 5 to 10 degrees relative to the axis of rotation of the drum so that the upper part of the nozzle face is cleaned first and the rest of the nozzle face is cleaned in a generally downward direction to ensure that any ink or other debris is thrown toward the bottom of the drum and onto the floor of the housing 34 instead of into the printer.

Figure 4:
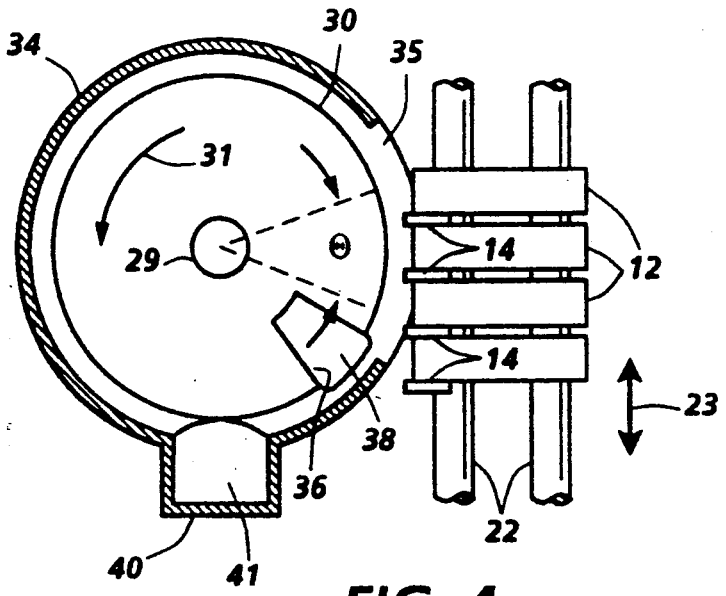
FIG. 4 is a top view of an alternate embodiment of the present invention.

An alternate embodiment is shown in FIG. 4, which is similar to the embodiment in FIG. 2, but has only one cleaning member 38. In this embodiment, the housing 34 has a vertical trough 40 containing a sponge assembly 41 comprising a sponge covered with a suitable film-forming polymer mesh, preferably Nylon ® mesh, similar to that which covers the cleaning member 38. A removable cover for an inlet (neither shown) in the trough 40 enables a cleaning liquid to be periodically added to the sponge 41 to keep it wet. The mesh covering the sponge isolates the sponge from the cleaning member 38 when they contact during rotation of the drum 30, and prevents transfer of particles larger than the pore size of the mesh to the cleaning member. When the cleaning member encounters the wet sponge assembly, moisture is exchanged, thus controlling the amount of moisture on the cleaning member 38. The wetness of the cleaning member is determined by the stiffness of the sponge, the pore size of the mesh covering the sponge, and the amount of interference occurring with the cleaning member. Since the printhead nozzles are about 60 $\mu$m in area, the mesh covering the cleaning member and sponge should have pores which are less than 60 $\mu$m and preferably between 10 and 40 $\mu$m. This way no contaminating particles or fibers can enter the nozzles from the cleaning member. Another advantage of the cleaning devices of this invention is that the cleaning liquid cannot be spilled if the printer is tipped over during relocation or servicing.

Figure 6:
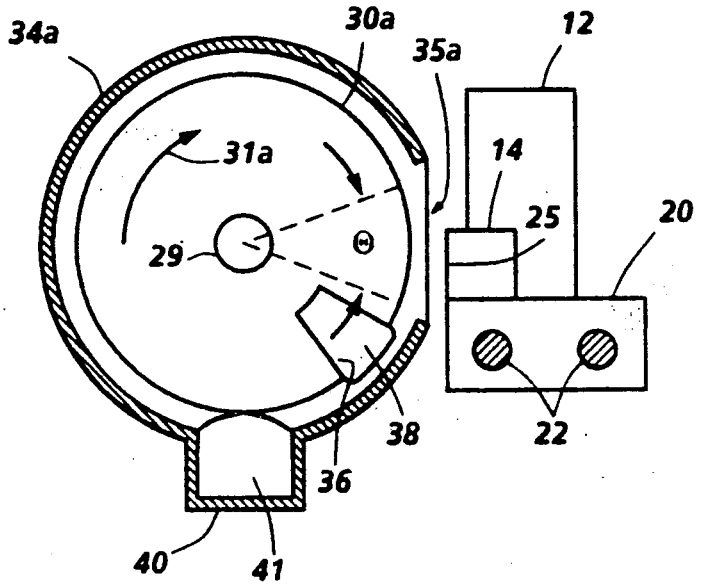
FIG. 6 is a side view of another embodiment of the present invention.

In FIG. 6, another embodiment of the invention is shown similar to that of FIGS. 1 and 4, except that the drum 30*a* is oriented so that its axis of rotation is parallel to guide rails 22 or translation direction of the carriage 20. The direction of rotation is from the top of the nozzle faces 25 downward as indicated by arrow 31*a*, so that any contaminants or debris not carried away by the cleaning member 38 will be thrown into the drum housing 34*a*. Two advantages of having the cleaning device in this configuration is that the same portion of the cleaning member contacts the same nozzle, so that ink removed by the mesh material will not mix with ink in a different printhead, and all of the nozzle faces may be cleaned concurrently rather than sequentially. The width of the slot 36 in drum 30*a* may be slightly larger than the similar slots in FIGS. 2–4, so that the cleaning member may be wide enough and extend outwardly from the drum to enable a cleaning relationship over the entire nozzle face which, in this configuration, is longer in the direction of rotation of the drum than the other embodiments.

Figure 5:
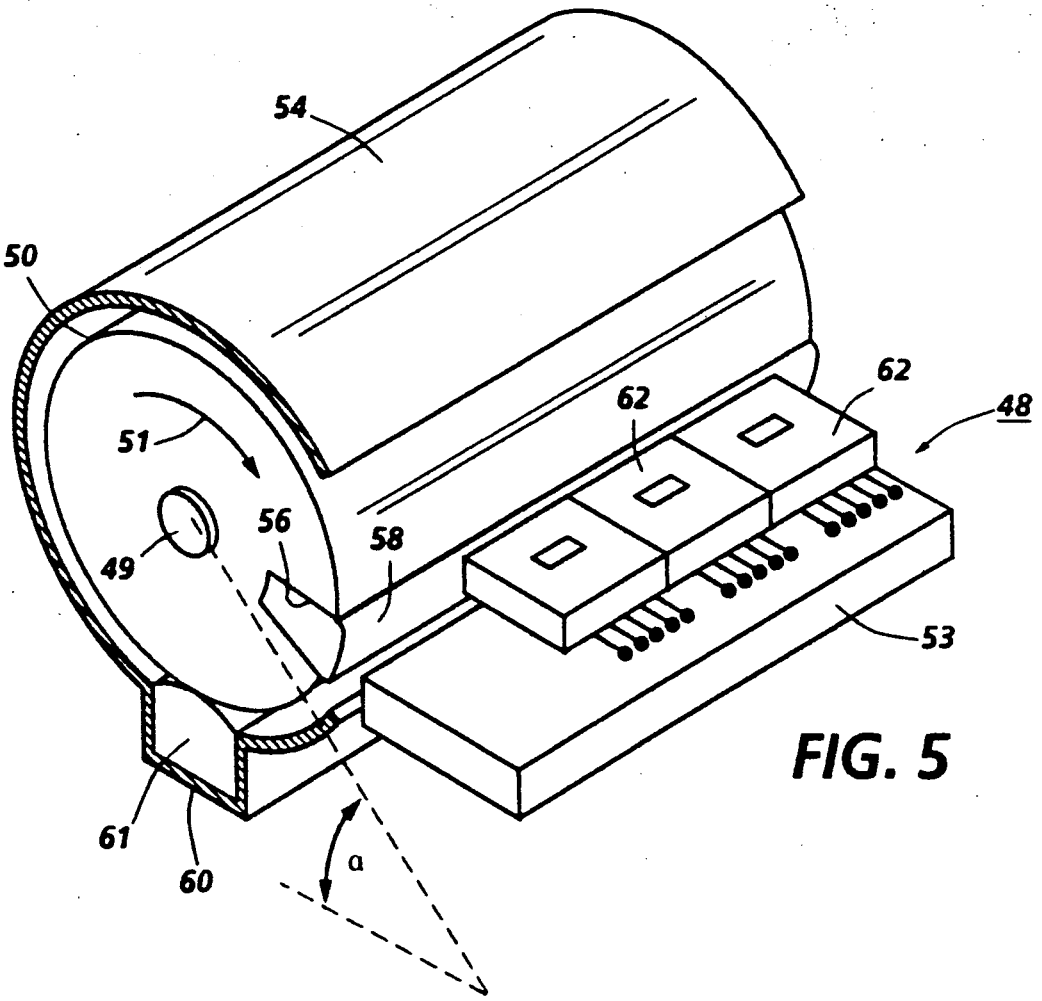
FIG. 5 is a partially shown isometric view of the cleaning device of the present invention arranged in a configuration for the cleaning of a pagewidth printhead nozzle face.

FIG. 5 discloses the cleaning device of the present invention in a pagewidth printer configuration. Fully functional printhead subunits 62 are abutted end-to-end and adhered to a structural bar 53 to form the pagewidth printhead 48 that is fixedly mounted in the printer (not shown). The cleaning and priming station comprises an elongated rotatable drum 50 mounted on shaft 49 and adapted for rotation about the shaft axis. The drum and shaft are generally parallel to the length of the pagewidth printhead and the nozzles in the combined nozzle face thereof; the pagewidth nozzle face is, therefore, the end-to-end, coplanar assembly of the nozzle faces of the printhead subunits. The slot 56 in the surface of the drum 50 is also parallel to the drum shaft or axis of rotation and is configured to receive a single elongated cleaning member 58 or a plurality of shorter cleaning members which may be inserted end-to-end in the slot. The slot 56 enables frictional engagement of the cleaning member or optionally may include other means to releasably retain the cleaning member such as, for example, one or more spring biased plates (not shown). Because the pagewidth printhead 48 is fixed, the rotatable drum with cleaning member 58 in slot 56 thereof must be moved from a cleaning and/or priming location closely adjacent the printhead nozzle face to a location which will not intefere with the printing operation in which the recording medium is transported past the pagewidth at a constant velocity and at a predetermined distance therefrom, generally about 20 mils. As in the carriage type cleaning device, the rotatable drum 50 of the pagewidth cleaning device is located in a housing 54. In the configuration shown, the embodiment depicts the single cleaning member with a means for keeping it moist. As in the embodiment shown in FIG. 4, a sponge assembly 61 comprising sponge and polymeric mesh covering it is inserted into a trough 60. The same technique is used to transfer moisture from the sponge assembly 61 to the cleaning member 58 as is used in FIG. 4. Cleaning liquid is also added and maintained in the sponge assembly by the manual addition through an aperture with replaceable lid (neither shown). The cleaning device, i.e., rotatable drum 50 and surrounding housing 54, are pivotable about an axis (not shown) for the angular distance $\alpha$ degress to move the cleaning device from a storage position during the printing operation to a cleaning and/or priming location adjacent the pagewidth nozzle face whereat the rotation of the drum 50 causes the cleaning member to wipe and mildly scrub the nozzle face in the downward direction as indicated by arrow 51. The housing has an elongated opening sufficient for the rotating cleaning member to extend therethrough and contact the nozzle face of the pagewidth printhead 48.

When the cleaning and priming stations are to be used for priming or storing of the printheads, whether of the carriage type or pagewidth type, the respective drums must be stopped so that the cleaning members are not aligned with the printhead nozzles. Thus, the nozzles may be periodically fired to eject ink droplets to keep the ink mensici at the nozzles from drying out. Also, the nozzles must be kept in a humid environment, so that ink drying on the nozzles as well as the mesh material of the cleaning members do not become clogged with dried ink. To this end, the openings in the respective housing must be sealed with the nozzle faces of the printheads. By means well known in the art, a collapsible cover attached to the housings at one end and fixed to a seal (not shown), which surrounds the nozzle face when moved into contact therewith, provides a closed environment in which the moist cleaning members keep humid. The seal may be moved into contact with the nozzle face by any suitable means such as by solenoid.

Many modifications and variations are apparent from the foregoing description of the invention and all such modifications and variations are intended to be within the scope of the present invention.

I claim:

1. A cleaning device for removal of ink and other debris from an ink jet printhead nozzle face containing a linear array of nozzles, the cleaning device being located at a cleaning station within an ink jet printer, comprising:

a rotatable structure having an axis of rotatin and having means for replaceably mounting at least one elongated cleaning member thereon for rotation thereby, said cleaning member comprising a length of absorbent material at least partially covered by a suitable film-forming polymer formed in a mesh material having a predetermined pore size, the pore size being smaller than the nozzles to prevent particles from the absorbent material which are larger than the pore size of the mesh material from entering the nozzles;

means for rotating the rotatable structure about an axis of rotation;

means for applying a cleaning liquid to the abosrbent material of the cleaning member in order to keep the cleaning member moist, so that the mesh material is maintained free of dried ink; and means for placing the rotatable structure and nozzle face adjacent each other, but spaced apart a predetermined distance at the cleaning and priming station, so that, upon rotation of the rotatable structure, the printhead nozzle face is mildly scrubbed by the mesh material of the cleaning member to remove any ink or other debris therefrom.

2. The cleaning device of claim 1, wherein the cleaning member is substantially parallel with the axis of the rotatable structure and the linear array of nozzles, and wherein the cleaning member wipes across the nozzle face during each revolution of the rotatable structure when said structure is rotated and the nozzle face is adjacent thereto at said cleaning station.

3. The cleaning device of claim 2, wherein the cleaning member is slightly skewed relative to the axis of rotation of the rotatable structure, so that the nozzle face is cleaned by a downward stroke.

4. The cleaning device of claim 3, wherein the skew of the cleaning member reltive to the axis of the rotatable structure is an angle of 5 to 15 degrees.

5. The cleaning device of claim 4, wherein the cleaning member has a length at least equal t the length of the array of nozzles.

6. The cleaning device of claim 5, wherein the mesh material is Nylon ®.

7. The cleaning device of claim 6, wherein the Nylon ® mesh material encases the absorbent material.

8. The cleaning device of claim 3, wherein the rotatable structure is a drum with a cylindrical surface and wherein the means for replaceably mounting the cleaning member comprises a slot in the drum surface having a width which provides a tight enough fit with the cleaning member manually inserted therein to capture and hold the cleaning member until said member is replaced with a new cleaning member.

9. The cleaning device of claim 8, wherein the ink jet printer is a carriage type printer which comprises a reciprocating carriage on which is mounted a printhead with the nozzle face and ink cartridge for reciprocation in a printing region across printing medium along a path parallel to the printing medium, the cleaning station being located on one end of the printing region; and wherein the means for placing the drum and nozzle face adjacent each other is accomplished by moving the carriage beyond the printing region along the path of reciprocation into said cleaning station.

10. The cleaning device of claim 9, wherein the printing station comprises a housing surrounding the drum with an opening therein which enables the rotating cleaning member to extend therethrough and contact the nozzle face; and wherein the means for applying a cleaning liquid to the absorbent material of the cleaning member comprises a trough in the housing parallel to the cleaning member containing a sponge covered by a filtering mesh material of a suitable film-forming polymer, the trough having an inlet means adapted for periodic supplying of said cleaning liquid thereto, so that the sponge will absorb the cleaning liquid, the mesh covered sponge extending from the trough, so that rotation of the drum causes the cleaning member to contact and be in interference with the mesh covered sponge containing the cleaning liquid and to be moistened thereby.

11. The cleaning device of claim 10, wherein the amount of interference occurring between the mesh covered sponge and cleaning member, together with the stiffness of the sponge and the pore size of the mesh material covering the sponge, determines the wetness of the cleaning member.

12. The cleaning device of claim 9, wherein the drum contains two slots with identical cleaning members manually positioned therein; and wherein one of the cleaning members is maintained dry.

13. The cleaning device of claim 12, wherein the printing station comprises a housing surrounding the drum with an opening therein which enables the rotating cleaning members to extend therethrough and contact the nozzle faces, when the printhead is moved to the cleaning station, and wherein the means for applying a cleaning liquid to the cleaning member to be moistened comprises a container within the housing and adjacent the cleaning member to be moistened, the container having an inlet with a removal cover and interconnecting passageway between the container and the cleaning member to be moistened, so that the moistened cleaning member wipes the nozzle face first, followed by the second dry cleaning member to remove excess liquid and ink.

14. The cleaning device of claim 2, wherein the ink jet printer is a multicolor carriage type printer having a plurality of printheads mounted on a translatable carriage for translation across a printing region in said printer; and where the axis of rotation of the rotatable structure is parallel to the translation direction of the carriage, so that each of the printhead nozzle faces may be concurrently cleaned by a corresponding portion of the cleaning member.

15. The cleaning device of claim 1, wherein the printhead of the ink jet printer is of the fixed, pagewidth type with the recording medium being moved therepast at a constant velocity along a pathway of predetermined distance from the nozzle face, the pagewidth printhead having a linear array of nozzles in the nozzle face that extends across the width of the recording medium;

wherein the cleaning station comprises a pivotable housing surrounding the rotatable structure with an elongated opening therein parallel to the nozzle face, the housing being pivotable between a first location where the nozzle face may be cleaned and a second location where the cleaning station is pivoted away from the nozzle face and recording medium pathway;

wherein the rotatable structure is a drum with a cylindrical surface rotatably mounted within the pivotable housing, the drum having a length at least equal to the nozzle plate and having a slot therein extending the length of the drum, the slot being parallel to the axis of rotation of the drum and the linear array of nozzles, the width of the slot being suitable for holding the cleaning member manually inserted therein until replaced with a new cleaning member; and wherein the means for applying the cleaning liquid to the cleaning member comprises a trough in the housing parallel to the axis of rotation of the drum and containing a sponge covered with a filtering mesh material of a suitable film-forming polymer having a predetermined pore size and a cleaning liquid, so that rotation of the drum when the cleaning station is in the first location causes the cleaning member to contact the mesh covered sponge in the trough and receive liquid therefrom and then wipe the nozzle face to remove any ink or debris therefrom.

16. The cleaning device of claim 2, wherein the pore size of the mesh material is between 10 and 40 μm.

17. The cleaning device of claim 8, wherein the geometric configurations of the cleaning member and the drum slot are determined so that, when the cleaning member is inserted into the slot, there is enough frictional engagement to retain the cleaning member in the slot until said member it is replaced with a fresh cleaning member.

18. The cleaning device of claim 8, wherein one side of the slot is spring biased.

19. The cleaning device of claim 8, further comprising means for the stopping of the respective drums so that the cleaning members are not aligned with the printhead nozzles.

20. The cleaning device of claim 10, wherein the housing surrounding the drum has a removable top sealingly attached thereto.

21. The cleaning device of claim 13, wherein the housing surrounding the drum has a removable top sealingly attached thereto.

22. A cleaning device for removal of ink and other debris from an ink jet printhead nozzle face containing a linear array of nozzles, the cleaning device being located at a cleaning station within an ink jet printer, comprising:

a rotatable drum with a cylindrical surface having an axis of rotation and having a slot in the drum surface substantially parallel with the axis of rotation for replaceably mounting at least one elongated cleaning member therein for rotation thereby, the drum slot being adapted to provide frictional engagement with the cleaning member for holding the cleaning member, thereby enabling periodic manual replacement thereof, said cleaning member comprising a length of absorbent material at least partially covered by a suitable film-forming polymer formed in a mesh material having a predetermined pore size, said cleaning member wiping across the nozzle face during each revolution of the drum when said drum is rotated and the nozzle face is adjacent thereto at said cleaning station;

means for rotating the drum about an axis of rotation;

means for applying a cleaning liquid to the absorbent material of the cleaning member in order to keep the absorbent material moist, so that the mesh material is maintained free of dried ink; and means for placing the drum and nozzle face adjacent each other, but spaced apart a predetermined distance at the cleaning station, so that, upon rotation of the drum, the printhead nozzle face is mildly scrubbed by the mesh material of the cleaning member to remove any ink or other debris therefrom.

* * * * *